United States Patent [19]

Weiss

[11] Patent Number: 4,637,438

[45] Date of Patent: Jan. 20, 1987

[54] METHOD AND DEVICE FOR FILLING CONTAINERS

[75] Inventor: Wilhelm Weiss, Regensburg, Fed. Rep. of Germany

[73] Assignee: Krones AG Hermann Kronseder Maschinenfabrik, Neutraubling, Fed. Rep. of Germany

[21] Appl. No.: 766,496

[22] Filed: Aug. 19, 1985

[30] Foreign Application Priority Data

Aug. 24, 1984 [DE] Fed. Rep. of Germany ..... 3431107

[51] Int. Cl.[4] ..... B65B 55/24; B67C 3/06

[52] U.S. Cl. ..... 141/6; 141/39; 141/70

[58] Field of Search ..... 141/1-12, 141/37-66, 70

[56] References Cited

U.S. PATENT DOCUMENTS 3,877,358 4/1975 Karr ..... 141/6

4,390,048 6/1983 Zelder ..... 141/6

*Primary Examiner*—Houston S. Bell, Jr.

*Attorney, Agent, or Firm*—Fuller, House & Hohenfeldt

[57] ABSTRACT

Containers such as bottles, which are to be filled with liquid from a tank pressurized with non-oxidizing gas, are coupled to a filling device and evacuated of air that is discharged to the atmosphere. Next gas from the tank is fed to the bottles. When gas pressure in the tank and bottle equalize, the liquid flows by gravity into the bottle to displace the gas and return it to the tank. After filling with liquid is cut off a charge of pure non-oxidizing gas is injected in the bottle to fill it to the top with pure gas. Excess pure gas is fed back into the tank to make up for the dilution of the gas that results from the evacuation of air from the bottles being necessarily imperfect. The bottles are uncoupled from the device after they are filled with pure gas and they are then sealed.

9 Claims, 4 Drawing Figures

METHOD AND DEVICE FOR FILLING CONTAINERS

BACKGROUND OF THE INVENTION

The invention disclosed herein relates to filling bottles or similar containers with a fluid wherein the bottle is evacuated, prefilled with an inert or oxygen-free protective gas such as carbon dioxide or nitrogen and then filled with fluid prior to the bottle being sealed. Although the method and device are applicable to a variety of containers, the word "bottles" will be used herein as generic to containers.

A vacuum and protective gas bottle filling machine is described in U.S. Pat. No. 2,808,856. In this known type of device, a protective gas which is displaced by the fluid admitted to the bottles is completely discharged into the atmosphere. With this device, liquids such as wines and hot fruit juices that are oxygen sensitive and foam easily can be bottled without oxygen absorption and without significant foaming. Known filling devices which first evacuate the bottles use great quantities of protective gas because it is discharged into the atmosphere and, thus, used only once. This known process is uneconomical. Furthermore, in prior art devices, the bottles are first filled with a protective gas and are temporarily exposed to atmospheric air pressure before they are filled with liquid. Thus, the protective gas can escape from the bottles and infusion of air into the bottles cannot be ruled out. In order to avoid this effect in the known devices, the ambient atmosphere around the filling devices is filled with inert gas such as nitrogen or carbon dioxide. However, this further increases consumption of protective gases which leak to the atmosphere outside of the filling machine.

SUMMARY OF THE INVENTION

One objective of the invention is to significantly reduce or minimize consumption of protective gas in bottling apparatus without the bottled contents being at risk of being exposed to harmful oxygen or other undesirable substances in air.

In accordance with the invention, the protective gas is used several times. Even in cases where the bottles are filled to their rim so that after filling they no longer contain protective gas, no protective gas is lost and the dedicated quantity of gas can be used repeatedly without supplementing it with pure protective gas to any significant extent. No opportunity is provided for creating uncontrolled bubbling because of the sudden impact of normal atmospheric pressure on the contents of the bottle.

Further in accordance with the invention, filling of the bottles is done under counterpressure conditions where the bottles are filled with liquid at the same pressure as the protective gas which occupies the entire bottle before the filling operation begins. The bottles are filled with liquid and sealed off from the atmosphere and held under the same pressure prevailing during the pre-filling and liquid filling steps. For topping off, pure protective gas is injected into the empty space in the neck of each bottle and the excess pure protective gas flowing out of the bottle is conveyed back into the storage tank for the protective gas. Under theoretical ideal conditions, no protective gas would be consumed in the method according to the invention. In reality, however, there will always be a small quantity of air in the bottles after they are subject to initial preevacuation, which air will mix with the protective gas that is introduced after evacuation. Moreover, a small quantity of protective gas is always left in the empty space above the liquid in the neck of the bottle which will be carried away with the bottle and is thus lost. Consequently, in accordance with another feature of the invention, pure protective gas from a supply source is added to the protective gas in storage so that the protective gas concentration and/or gas quantity in the protective gas storage container is held at a desired level.

Pure protective gas for making up that which is variously lost could be added directly to the protective gas and fluid storage tank. According to another feature of the invention, however, the pure protective gas is added in the empty space in the neck of the bottle after it is filled and the displaced excess protective gas which is displaced from the bottles is added to the protective gas storage vessel. In this way, the fluid in the bottle is topped with pure protective gas which, thus, minimizes oxidation of the liquid after the bottles are filled and capped or corked. The injected pure protective gas displaces the liquid from the bottle which stands above the desired filling height.

The new device embodies only one storage tank which stores the liquid as well as the protective gas. The individual bottle filling stations perform all of the filling steps and eliminate the need for any auxiliary gas, liquid or vacuum stubs. The bottles remained sealingly coupled to the filling stations during the entire filling process so the liquid in the bottles is never exposed to surrounding air. Consequently, a protective gas filled ambient enveloping the filling stations is not needed.

A more detailed description of a preferred embodiment of the method and apparatus which achieves optimal protective gas conservation and freedom of exposure of the bottled liquid to oxygen will now be described in reference to the drawings.

DESCRIPTION OF A PREFERRED EMBODIMENT

Figure 1:
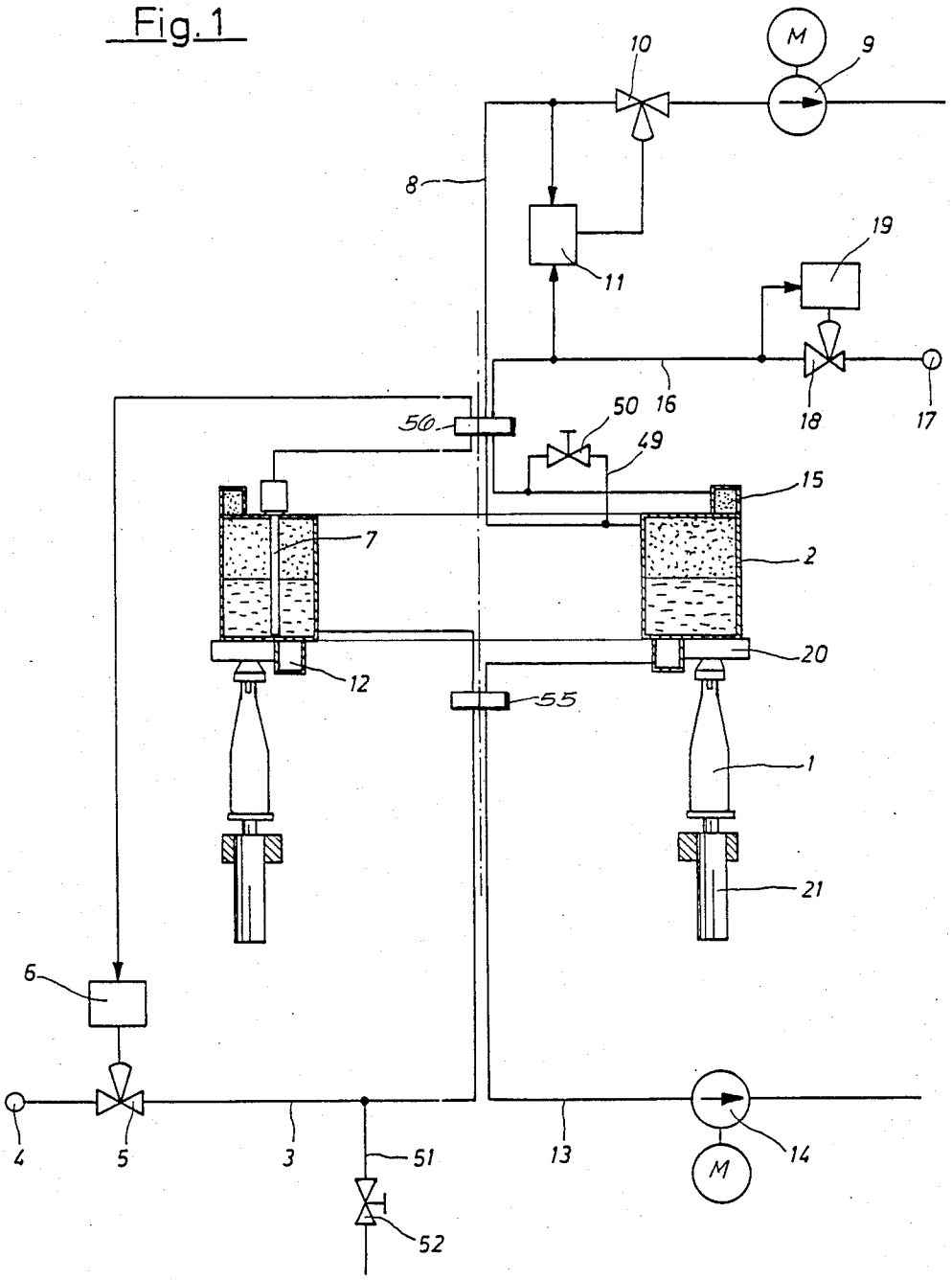
FIG. 1 is a schematic diagram of a bottle filling device in accordance with the invention.

The device depicted in FIGS. 1 through 4 is especially useful for filling containers such as bottles 1 with liquids, such as wine, that are oxygen-sensitive and are inclined to foam. The device comprises an annular tank 2 which is shown in section in FIG. 1. The liquid which is to be bottled is supplied to tank 2 through a line 3 from a liquid supply source 4 which is under normal atmospheric pressure or slightly above atmospheric pressure. Fluid is fed from line 3 to tank 2 through a rotary distributor which is symbolized by the block marked 55. There is a regulating valve 5 in line 3 which is controlled by a regulator 6. Regulator 6 is responsive to a fill level sensor 7 which is installed inside of tank 2 and senses the liquid level. Regulator 6 is operative to hold the height of the liquid in tank 2 at a set value by modulating the opening of regulating valve 5.

The space above the upper surface of the liquid in tank 2 is filled with a non-oxidizing protective gas such as carbon dioxide. A line 8 connects to the upper part of tank 2 and to the input of a first motor driven vacuum pump 9. There is a rotational distributor 56 through which line 8 is coupled to tank 2. There is a regulating valve 10 in line 8 which is controlled by regulator 11 whose function will be discussed below.

On the underside of tank 2 there is a lower annular channel 12 that serves as a vacuum header. A line 13 connects annular channel 12 to the input of a motor driven second vacuum pump 14. Vacuum pump 14 evacuates lower annular channel 12 continuously to an absolute pressure of about 0.1 bar.

The term "bar" is used herein to designate pressure. A bar is defined as a pressure of one million dynes per square centimeter or 75.007 cm. of mercury at 0° C. and in a latitude of 45°. The bar is commonly used by meteorologists to indicate standard pressure and temperature conditions. The bar can be thought of as atmospheric pressure.

On the top of tank 2 there is an upper annular channel or header 15 which is connected by way of a line 16 with a protective gas source 17. Typically the gas is carbon dioxide well above atmospheric pressure such as 5 bars. Line 16 runs through a rotary distributor 56. There is a pressure reducing valve 18 in line 16 and this valve is controlled by a pressure regulator device 19. Reducing valve 18 is controlled by regulator 19 to establish a constant pressure in upper annular channel 15 of about 0.1 bar above atmospheric or 1 bar reference pressure. Alternatively, it is permissible to reduce the pressure in upper channel 15 to atmospheric value. Regulator 11 for the regulated valve 10 is a differential pressure regulator. One side of regulator 11 is connected to line 8 and the other side is connected to line 16. The regulator regulates valve 10 such as to maintain a pressure in upper annular channel 15 that is 0.15 bar higher than the pressure in line 8 and tank 2. Thus, the pressure in tank 2 is 0.05 bar above atmospheric or 1.05 bar, for example. The pressure in upper channel 15 is made greater than the pressure maintained in tank 2 because, as will be seen later, gas from upper channel 15, after being used to purge the bottle after its liquid filling is complete will be saved by letting it flow into the gas filled slightly lower pressure space above the liquid in tank 2.

Figure 2:
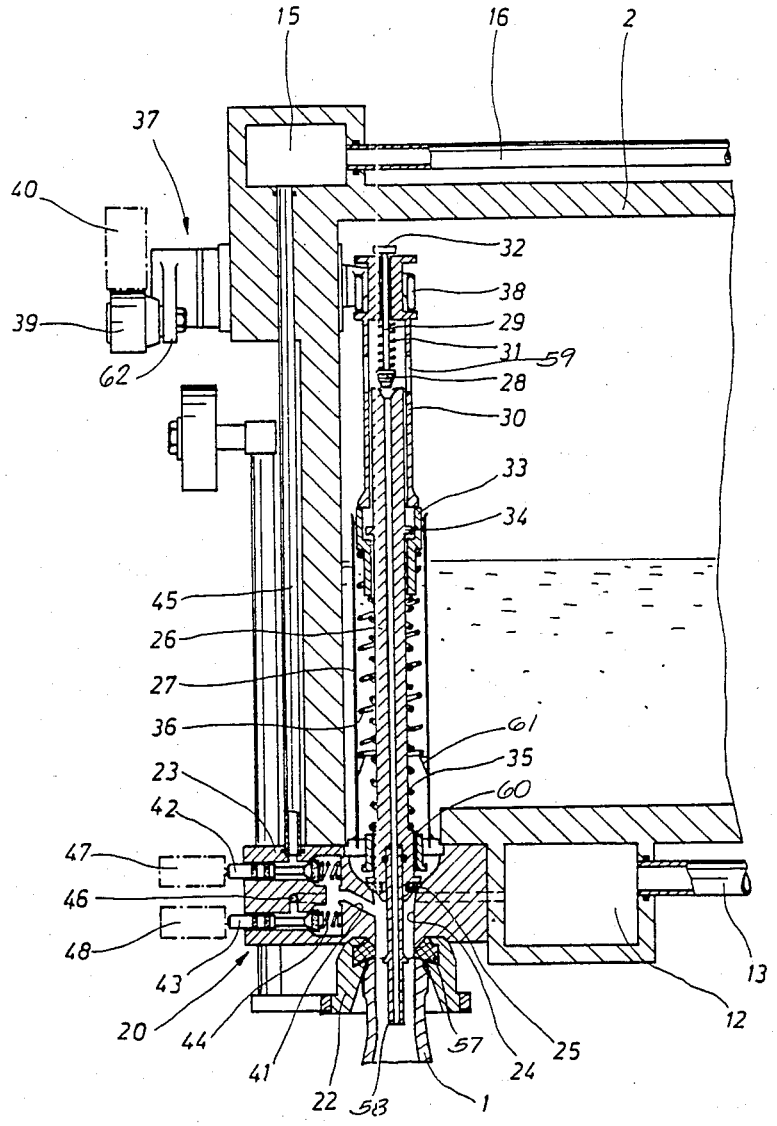
FIG. 2 is a vertical section of the liquid storage tank and one filling station of the device with the valve for feeding liquid to the container closed and the valve for feeding gas to the container open.

Several bottle filling stations 20 are arranged around the circumference of tank 2. A bottle lift mechanism 21 which rotates together with tank 2 lifts the bottles to engage them with the filling station. Lift mechanism 21 presses a bottle which is to be filled into gas and liquid tight connection with filling station 20 as shown in FIG. 2. The bottles enter a tapered centering cap 22 and press tightly against an elastic sealing gasket 57. Each filling station 20 includes a block 23 which is attached to the underside of tank 2 in line with an opening in the bottom of the tank. In block 23 there is a passageway or outlet 24 through which liquid passes on its way to bottle 1. Outlet 24 is shaped to form a seat for a liquid valve stem 25 which when it is in contact relationship with the wall of outlet passageway 24 shuts off liquid flow to the bottle. The liquid valve stem is actually a valve disk 25 mounted on a vertically movable gas conducting tube 26. Gas tube 26 is movable vertically in a fixed bushing 27 which is concentric with liquid outlet passageway 24. Gas conducting tube 26 has a smaller extension 58 which extends through outlet 24 and into bottle 1 when the bottle is pressed against elastic seal 57. The lower open tip of extension gas tube 58 is at a level that coincides with the level to which the bottle will be properly filled with liquid. The upper opening of gas tube 26 lies above the level of the liquid in tank 2. The upper end of gas tube 26 has a recess which is shaped to serve as a seat for a conically shaped gas valve stem or disk 28.

Gas valve stem 28 is guided for vertical movement by means of a needle 29 in a control member 30. There is a compression spring 31 interposed between the upper face of gas valve stem 28 and a vertically movable, generally tubular, control member 30. Compression spring 31 tends to press gas valve stem 28 downwardly toward the upper valve seat opening of gas tube 26. The lowest position of gas valve stem 28 relative to control member 30 is established by a head 32 on the upper end of needle stem 29. The vertically movable arrangement of the gas valve stem 28 in combination with compression spring 31 serves to even out tolerances in the forcible closing of the gas valve defined by the upper opening in gas tube 26 and gas valve stem 28 and to cause sufficient closing force under all circumstances. Tubular control member 30 is slidable relative to the upper end of gas tube 26. Control member 30 has some lateral apertures 59 for communicating gas to and from the central bore of gas tube 26. There is a generally tubular shaped stop member 33 below control member 30. Stop member 33 flares out at its upper end to provide a clear annular space around gas tube 26. The upper limit position of stop 33 is determined by a radially extending shoulder 34 on gas tube 26. Inserted between stop 33 and a stop 60 formed further down on gas tube 26 is a compression spring 35 which tends to press stop 33 against annular shoulder 34. Another compression spring 36 acts on stop 33 and this spring reacts against some ears 61 which are formed on bushing 27. Thus, compression spring 36 tries to lift fluid valve stem 25 by way of shoulder 33, ring stop 34 and gas tube 26 off of its seat to thereby open the fluid valve.

Tubular control member 30 first controls the height position of gas valve stem 28 which it carries. Secondly, control member 30 acts on liquid valve stem 25 either directly by way of annular radially extending stop 34 on gas tube 26 or by way of shoulder 33 through the agency of compression spring 35. The height position of the control member 30 itself is controlled by an actuating mechanism indicated generally by the numeral 37. Mechanism 37 embodies a bushing, not visible, in the sidewall of tank 2 to provide a gas tight and self-braking bearing for a control shaft. There is a shift fork 38 fastened to the end of the control shaft. The fork engages a ring groove, comparable to the body of a spool, which is formed at the upper end of control member 30. A cam roller 39 is mounted rotatably to a lever 62 which rotates the shaft that turns the shift fork 38. With tank 2 rotating, lever 62 is actuated by stationary control dogs or curved tracks 40 and the lever remains at any angle to which it is forced because there is a frictional drag between the shaft and bushing as a result of using parts which are not visible.

In block 23 at the bottom of the tank in FIG. 2 one may see a duct 41 which ends below the fluid valve stem 25 in outlet 24 and connects on its other end with the exit of a protective gas valve 42 and of a vacuum valve 43. Gas valve 42 and vacuum valve 43 each have a push rod sliding horizontally in block 23 and have a conical valve stem which is pressed by compression spring 44 against a mating valve seat. The inlet side of protective gas valve 42 is connected to upper annular gas channel 15 with a piece of tubing 45 which is attached at one end in block 23 and on the other in tank 2. The inlet side of vacuum valve 43, on the other hand, however, is connected to the lower annular vacuum header channel 12 by means of a duct 46 which has been formed in block 23. Thus, if the push rod of protective gas valve 42 is pressed in opposition to its spring, for example, by a stationary curved cam track 47, protective gas can flow from the upper annular channel 15 into outlet 24. If the push rod of vacuum valve 43 is pressed, for example, by a stationary curved track 48, air is exhausted from outlet 24 and bottle 1 by the influence of vacuum that is maintained in lower annular channel 12.

As shown in FIG. 1, there is a valve 50 in a line 49 which connects line 8 leading to tank 2 and line 16 leading to the gas input source 17. Valve 50 can be opened such that, if necessary, tank 2 can receive protective gas from source 17 directly. In addition, a flushing line 51 with a shut off valve 52 is connected to line 3, by which tank 2 can be filled with water, for example. Prior to starting the filling operation, tank 2 is filled preferably completely with water which is then forced out of tank 2 by means of carbon dioxide gas pressure obtained by opening valve 50 temporarily. Then tank 2 is filled with liquid through control valve 5 up to the desired liquid level after shut off valves 50 and 52 are closed. In this way contact of air with liquid is prevented at the outset and, at the same time, tank 2 is filled with the necessary supply of protective gas. Although they are not shown, it will be understood that there are additional shut off valves and venting valves which make it possible to displace one fluid in an enclosure such as the tank with another.

By switching on first vacuum pump 9, carbon dioxide gas is evacuated from tank 2 by means of regulator 11 and its controlled valve 10 until the desired atmospheric or slightly below atmospheric pressure is established in tank 2. When the pressure is established control valve 10 closes automatically and no more carbon dioxide gas is removed. Regulators 6 and 19 controlling valves 5 and 18, respectively, continue their function so that if necessary, liquid or carbon dioxide gas can be added. With the switching on of the second vacuum pump 14, the device is initialized and ready for operation as will now be described.

Figure 4:
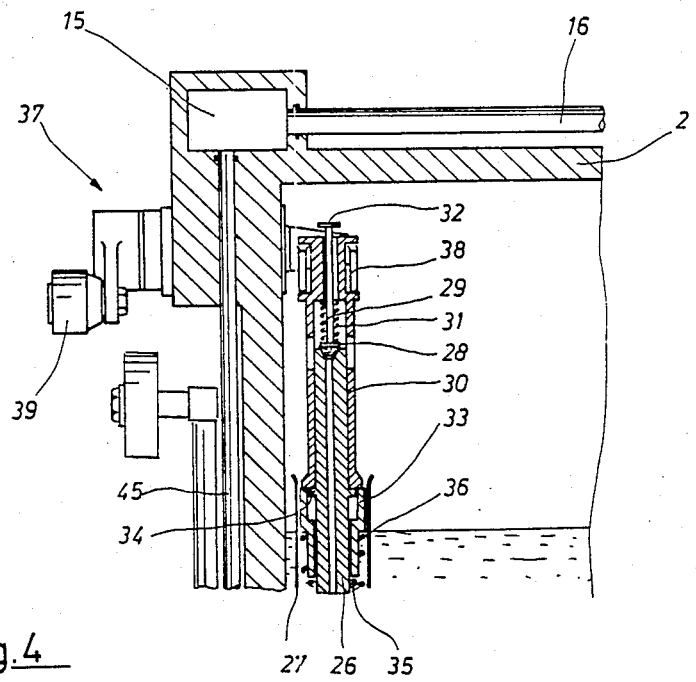
FIG. 4 is a partial vertical section of the storage tank and filling station with the valve for feeding liquid and the valve for feeding gas to the container closed.

When the lifting devices 21 are in that part of their circumferential path at which they have no bottle on them, mechanism 37 holds control member 30 in its lowest position as shown in FIG. 4. As a result, the control member 30 presses its lower end against annular radially extending shoulder 34 on gas tube 26 downwardly, thereby pressing liquid valve stem 25 firmly against its seat in outlet 24, and thus the liquid valve is held forcibly closed. Concurrently, gas valve stem 28 is pressed by control member 30 by way of compression spring 31 tightly against the upper end of gas tube 26 and, thus the gas valve is held forcibly closed. Auxiliary protective gas valve 42 and auxiliary vacuum valve 43 are also held closed by a spring such as the one marked 44. The store of liquid and gas in tank 2 is thus completely shut off from the atmosphere and no air can seep into the tank.

Next, as the filling device rotates with the tank, an empty bottle 1 is pressed by lift mechanism 21 firmly against seal 57 of a filling station 20. Thereafter, vacuum valve 43 is opened briefly by the stationary curved track 48 to thereby create a high vacuum in all cavities in communication with outlet 24 and bottle 1. The air evacuated from the bottle 1 and outlet passageway 24 flows without contacting any liquid through duct 41, vacuum valve 43, duct 46, lower annular evacuated channel 12 and line 13 and second vacuum pump 14 into the ambient atmosphere.

Figure 3:
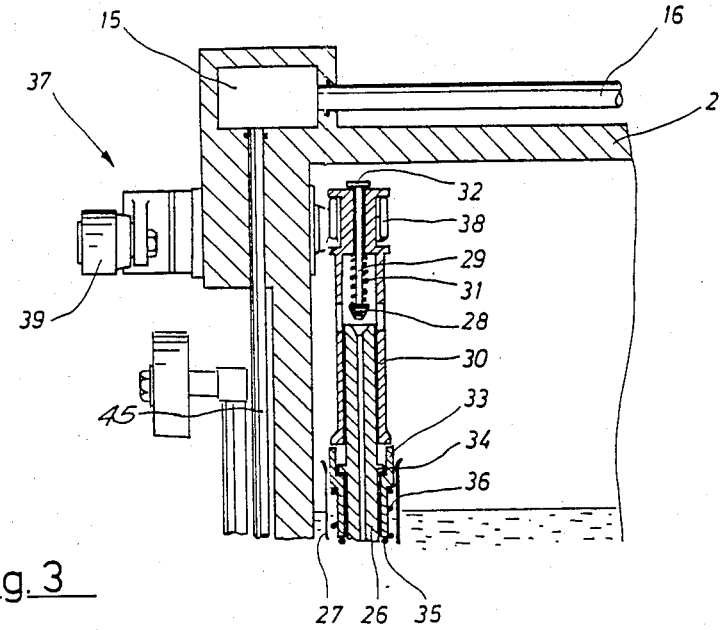
FIG. 3 is a vertical partial section of the tank and a filling station of the device with the valve for feeding liquid to the container and the valve for feeding gas to the container open.

When the brief period for exhausting air from the bottle has ended, the timing of the device is such that control member 30 is controlled by mechanism 37 cooperating with a stationary control dog 40 into the upper position of the control member and held there as demonstrated in FIG. 3. Upon this event, gas valve stem 28 is lifted off of its seat at the upper end of gas tube 26 by reason of control member 30 reacting against the head 32 on valve stem or needle 29 and, thus, the gas valve is forcibly opened. Because of the significant pressure differential between evacuated bottle 1 and tank 2, the protective gas such as carbon dioxide now flows rapidly from tank 2 through gas tube 26 into bottle 1. In a brief interval, gas pressure equilibrium is achieved between the pressure in tank 2 and bottle 1. In the transition of control member 30 to its upper end position, its lower face lifted off annular shoulder 34 on gas tube 26 and from shoulder 33 which is now lifted by spring 35 against shoulder 34. Gas tube 26 with liquid valve stem 25 is thereby released. Under the influence of vacuum in bottle 1, gas tube 26 remains in its lower end position and holds the liquid valve 25 closed until, in a previously described way, pressure equalization between tank 2 and bottle 1 occurs and bottle 1 is now actually filled with protective gas. In response to pressure equalization, gas tube 26 is lifted under the influence of compression spring 36 acting against shoulder 33 and annular shoulder 34 and the fluid valve is thereby opened automatically. Compression spring 35 is not involved in this event. With the liquid valve 25 open, the liquid can flow into the bottle solely under the influence of gravity since the pressure in tank 2 and the bottle 1 are in equilibrium and the liquid level in tank 2 is slightly higher than the bottle. Gravitational drainage of the liquid from the tank minimizes turbulence of the liquid being bottled and, hence, avoids foaming of the liquid. As the bottle is filled with liquid, the protective gas being displaced by the liquid is conducted through the gas tube 37, extension 58 and the gas tube 26 itself back into tank 2 where it is stored. At this time the gas fed back into tank 2 is diluted only slightly with air to the extent that the vacuum created in the bottle before the gas entered is less than perfect. The liquid filling process is automatically interrupted when the liquid in the bottle 1 has reached the level of the lower tip of the gas tube 26 extension 58 so that the liquid closes off the gas tube. Usually a filling height results which rises a little bit above the level of the level of the lower opening in gas tube extension 58.

Next, the control member 30 is driven to its center position by the operating mechanism 37 in conjunction with control dog 40 as demonstrated in FIG. 2. The lower end of the control member 30 thereby presses against shoulder 33. This compresses spring 35 whose lower end is reacting against a shoulder 60 at the lower end of the gas tube 26. This drives the liquid valve stem 25 downward against its seat. Therefore, the liquid valve becomes forcibly closed. At the same time, the gas valve stem 28 is lowered and also brought closer to its seat, but not pressed against the seat. Therefore, the gas valve remains forcibly opened. Now auxiliary protective gas valve 42 is briefly opened as a result of it reacting against stationary curved cam track 47. This results in pure undiluted carbon dioxide or protective gas flow from upper channel 15 through tubing 45, auxiliary gas valve 42 and duct 41 into bottle 1 and the undiluted gas displaces the liquid above the lower end of gas tube extension 58 through the forcibly opened gas valve 28 back into tank 2. This liquid displacing gas flow is at a modest velocity because the pressure differential between the auxiliary gas pressure in upper annular channel 15 is only 0.15 bar greater than the pressure in tank 2. The liquid displaced from the upper end of bottle 1 and the driving carbon dioxide gas do not have to pass through any restrictions so they escape relatively slowly from the opened gas valve 28 into tank 2. With this gentle correction of the liquid fill level, therefore, no disturbance of the liquid occurs in the bottle 1 nor tank 2 nor is there any entrapment of any significant quantity of liquid from a level below the lower tip of gas tube extension 58. Bottle 1 is now filled with liquid exactly to the correct height and the space in the neck of the bottle above the liquid contains pure carbon dioxide protective gas which is heavier than air so that no oxygen can enter the neck of the bottle.

The opening time of auxiliary protective gas valve 42 is made such that the quantity of escaping carbon dioxide gas is larger than would be needed to fill the space in the neck of the bottle above the liquid. The excess carbon dioxide gas flows through the gas tube 26 from bottle 1 into tank 2 and is collected there for further usage. The resulting increase in pressure in tank 2 is equalized by control valve 10 and its regulator 11 through exhausting a sufficient quantity of gas through the first vacuum pump 9.

The quantity of excess carbon dioxide gas is furthermore determined in such a way that it counteracts an enrichment of the protective gas stored in tank 2 with residual air left from the preevacuation of the bottles, and that it keeps such enrichment within acceptable limits. The conditions for filling the bottle are not affected thereby.

After closure of protective auxiliary gas valve 42, control member 30 is lowered into its lower end position as in FIG. 4 by mechanism 37 in conjunction with control dog 40 and held there. Downward movement of control member 30 compresses spring 31 which drives gas valve stem against its seat on gas tube 26 and the gas valve is thereby forcibly closed. Tank 2 with the liquid and protective gas store are thereby completely separated from the atmosphere. The filled bottle 1 is now removed from filling station 20 after lowering of the corresponding lifter 21 and then sent immediately to bottle closing station which is not shown.

I claim:

1. A method of filling containers such as bottles with a liquid which partially fills a tank and the space above the liquid is filled with a protective gas, said method including the steps of:

evacuating most of the air from a bottle while the bottle is isolated from the atmosphere, filling said bottle with said gas from the tank to a pressure equal to the pressure in the tank, causing said liquid to flow by gravity from said tank to said bottle until the bottle is filled to a predetermined level and said liquid in the bottle displaces said gas back into said tank except for residual gas slightly diluted with air above said level, briefly injecting a quantity of pure protective gas into said bottle in excess of the quantity necessary to displace said residual gas, and conducting the displaced gas and excess pure protective gas to the gas filled space in the tank before the contents of said bottle are exposed to the atmosphere.

2. The method according to claim 1 wherein the pressure of the injected pure protective gas is at least atmospheric pressure.

3. The method according to any one of claims 1 or 2 wherein sufficient pure protective gas is injected into said bottle to displace any excess liquid in said bottle as well as said residual gas and to force said excess liquid back into said tank.

4. The method according to any one of claims 1 or 2 including the step of adding pure protective gas to said tank in sufficient quantity to maintain the concentration of said gas in said tank at a predetermined value.

5. The method according to claim 4 including the step of pumping gas from said tank in sufficient quantities to compensate for input of said excess injected gas to said tank so the pressure in said tank will remain substantially constant.

6. Apparatus for filling containers such as bottles with a liquid comprising:

a tank for being partially filled with said liquid so the space above said liquid can be filled with a protective gas provided from a source of gas, means for maintaining the gas in said tank at a predetermined pressure, at least one bottle filling device mounted to said tank, said device having an outlet including means for sealingly engaging with a bottle, said device also having first valve means through which the outlet communicates with the gas filled spaced in the tank and second valve means through which the outlet communicates with the liquid filled space in the tank, third valve means through which said outlet in said device communicates with a vacuum source and fourth valve means through which said outlet communicates with a source of concentrated protective gas at a pressure slightly higher than the pressure in said tank, means for controlling the operational sequence of said valve means such that said fourth valve means opens momentarily to evacuate most of the air from said bottle and closes, said second valve means opens to conduct protective gas from said tank to the evacuated bottle, said third valve opens for an interval and closes such that during said interval liquid flows from said tank by gravity into said bottle and said liquid displaces said gas back into said tank except for a quantity of residual gas in the space above the liquid fill level which remains after the third valve closes, and said fourth valve means opens briefly to inject pure protective gas into said space in the bottle for displacement of said residual gas back into said tank.

7. The apparatus according to claim 6 wherein at least part of the liquid in said tank is on a higher level than said outlet of said bottle filling device.

8. The apparatus according to claim 6 including a first vacuum pump and a line connecting the inlet of said pump to the gas filled space in the tank, a valve in said line and regulating means for said valve, said regulating means regulating flow through said valve to maintain a gas pressure in said tank slightly lower than the pressure at which said pure protective gas is injected into said bottle through said fourth valve means.

9. The apparatus according to claim 6 including a regulatable valve having an inlet connected to a source of the filling liquid and an outlet connected to said tank, valve regulator means and a liquid level sensor in said tank, said regulator means responding to said sensor by regulating said valve to maintain a substantially constant liquid level.

* * * * *